US008510900B2

(12) United States Patent
Escarpa Gil

(10) Patent No.: US 8,510,900 B2
(45) Date of Patent: Aug. 20, 2013

(54) WRINGER FOR MOPS AND THE LIKE WITH DEVICE FOR FILTERING THE WASHING WATER

(75) Inventor: Julián Escarpa Gil, Aldaia (ES)

(73) Assignee: SP Berner Plastic Group, S.L., Aldaia (Valencia) (ES)

( * ) Notice: Subject to any disclaimer, the term of this patent is extended or adjusted under 35 U.S.C. 154(b) by 107 days.

(21) Appl. No.: 13/074,054

(22) Filed: Mar. 29, 2011

(65) Prior Publication Data

US 2011/0289715 A1 Dec. 1, 2011

(30) Foreign Application Priority Data

May 28, 2010 (ES) ..... 201030816
May 28, 2010 (ES) ..... 201030817

(51) Int. Cl.
*A47L 13/14* (2006.01)

(52) U.S. Cl.
USPC ..... 15/260; 15/261; 68/241

(58) Field of Classification Search
USPC ..... 15/260–263; D32/53; 68/241, 248; 100/131, 132
See application file for complete search history.

(56) References Cited

U.S. PATENT DOCUMENTS

| | | | |
|---|---|---|---|
| 6,115,877 | A | 9/2000 | Morad et al. |
| 2004/0149643 | A1 | 8/2004 | Vandenbelt et al. |
| 2005/0086760 | A1 | 4/2005 | Young |
| 2007/0094834 | A1 * | 5/2007 | Gil ..... 15/261 |
| 2007/0267832 | A1 | 11/2007 | Denissov |

FOREIGN PATENT DOCUMENTS

| | | |
|---|---|---|
| DE | 118 056 | 8/1900 |
| EP | 1 743 565 | 1/2007 |
| ES | 1 001 933 | 5/1988 |
| ES | 1 041 890 | 8/1999 |
| ES | 1 042 163 | 8/1999 |
| ES | 2 312 388 | 3/2009 |
| GB | 1 520 839 | 8/1978 |
| GB | 2 260 691 | 4/1993 |
| WO | 03/065869 | 8/2003 |

OTHER PUBLICATIONS

European Search Report issued Sep. 29, 2011 in corresponding European Application No. 11 38 0034.
Spanish Search Report issued Nov. 2, 2012 in corresponding Spanish Application No. 201030816.
Spanish Search Report issued Nov. 7, 2012 in corresponding Spanish Application No. 201030817.

* cited by examiner

*Primary Examiner* — Shay Karls
(74) *Attorney, Agent, or Firm* — Wenderoth, Lind & Ponack, L.L.P.

(57) ABSTRACT

A wringer for mops and the like comprising a united structure made of plastic material with two rocking bodies 1 separated by "V"-shaped channeling 2 and which are joined at the bottom by middle fins 3, the rocking bodies 1 having elastic hinge elements 14 and end portions 9 of elastic structure through which the wringer is anchored to the mouth of the mop bucket 10, the end portions 9 having spring elements 15 for recovering the rocking bodies 1. In addition the wringer 4 can have middle indentations 22 for allowing placement of a device for filtering cleaning water, which comprises a tray support 5. This device for filtering cleaning water is placed under the wringer 4. When water passes through the filtering device that is under the wringer 4, reaches the bucket already filtered with fewer dirt particles.

13 Claims, 8 Drawing Sheets

WRINGER FOR MOPS AND THE LIKE WITH DEVICE FOR FILTERING THE WASHING WATER

OBJECT OF THE INVENTION

The present invention, as the title of this specification states, relates to a mop wringer that is placed in a bucket for mops or the like and which allows wringing a mop without the need of carrying out rotational movements of the mop itself at the time of wringing. Furthermore, the wringer may have some fitting holes into which a tray support that is under the wringer, and which is a device for filtering the washing water is placed, wherewith some of the dirt attached to the mop head of the mop is retained in the filtering device when the mop is wrung.

Thus, using the wringer of the invention it is only necessary to vertically press down on the mop, and during this operation the winger structure presses against the mop head of the mop for wringing thereof. Another advantage of the present invention is that when the device for filtering washing water is placed under the wringer, as some of the dirt in the mop head is retained in the filtering device, it is not necessary to change the initial water so often.

BACKGROUND OF THE INVENTION

Mop wringers for floor-scrubbing buckets are known, which are adapted to the mouth of the buckets and that have a structure that includes an inverted truncated cone-shaped cavity at its bottom and a side wall with holes, in order to wring the mop, the mop head is introduced therein pressing and rotating the mop.

Other wringers include a structure that comprises a frame for being fastened to the bucket and downwardly converging flexible elements joining in correspondence with a perforated lower base. When the mop is pressed down, the flexible elements press the mop head for wringing and these elements recover their resting position when released.

Among these wringers, there is for example, the invention described in US2002/0066152 comprising a set of narrow flexible sheets that define a truncated cone-shaped space and converging downward in a circular base.

Another example of this type of wringers is the patent EP489237 comprising two symmetric groups of narrow flexible sheets converging toward the bottom, which end in an approximately rectangular base.

Patent ES2238935 discloses a wringer of the type described above, which comprises two separate wringing pieces that are hingely coupled to two parallel shafts arranged in correspondence with some end boxes of the frame-support limited by front facing walls and lower bottoms.

These patents disclose wringers for wringing the mop head of the mop during the process of cleaning and scrubbing the floors of houses and other premises. When scrubbing, the dirt from the floor is collected by the mop head of the mop so that when the mop is wrung, the particles of that dirt fall into the water that is in the bucket and after each wringing, the mop gets wet again in the bucket water so that some of the particles collected in the water go back to the mop.

Conventionally, to avoid this problem it has been chosen to change is the bucket water from time to time with the consequent water cost that this entails. Thus, it is necessary to design a device whereby some particles of dirt existing in the mop head of the mop be retained when said mop head is wrung, so as not to come back to the bucket water and thus extending the cycle time with the same initial water.

DESCRIPTION OF THE INVENTION

The wringer for mops and the like, object of the invention, comprises a one-piece structure anchored in two opposite areas of the mouth of a mop bucket. Said one-piece structure is formed by two rocking bodies connected by means of middle fins.

The rocking bodies have in turn curve-concave inside walls, wherein there are the slots, and curve-convex outside walls. The inside and outside walls are connected by means of sloping wings reaching side areas of the inside walls.

Curve-convex outside walls have some central flat portions from whose free edges end portions project. The wringer is thereby anchored to the mouth of the corresponding bucket.

The end portions have spring elements that help to recover the resting position of the wringer assembly after each mop wringing. The mop head thereof contacts the curve-concave inside walls during wringing.

Each time the mop is pressed down on the two curve-concave inside walls of the one-piece structure, the two rocking bodies are hinged toward the inside clamping and pressing the mop head of the mop for wringing. Rocking is performed in the corresponding areas of the spring elements and in the projecting area of the end portions bringing the two curve-concave inside walls closer to each other.

Between the end portions and the central flat walls of the curve-convex outside walls middle grooves that may have middle notches to allow fitting a tray support that acts as a device for filtering the washing water are formed.

The tray support has a recessed cavity having fastening means for interchangeably placing a filter body, preferably defined by a non-woven fabric material.

The user can acquire several filter bodies as a spare so that when the filter body in use is saturated with dirt retained therein, it can manually be changed by a new one. This is a quick and easy operation.

Every time the mop is wrung in the wringer, the water wrung passes through the filter body before reaching the bucket so that the filter body retains most of the dirt particles collected by the mop head of the mop during floor scrubbing.

The bottom of the recessed cavity of the tray support has through holes that will distribute the previously filtered water towards the inside of the bucket itself.

Thus, by adding the device for filtering washing water the time of the washing operation is optimized and global water consumption is also optimized.

Next, to provide a better understanding of this specification and as an integral part thereof, some figures in which the object of the invention has been represented in an illustrative and not limitative manner are attached.

REFERENCES

Figure 1:
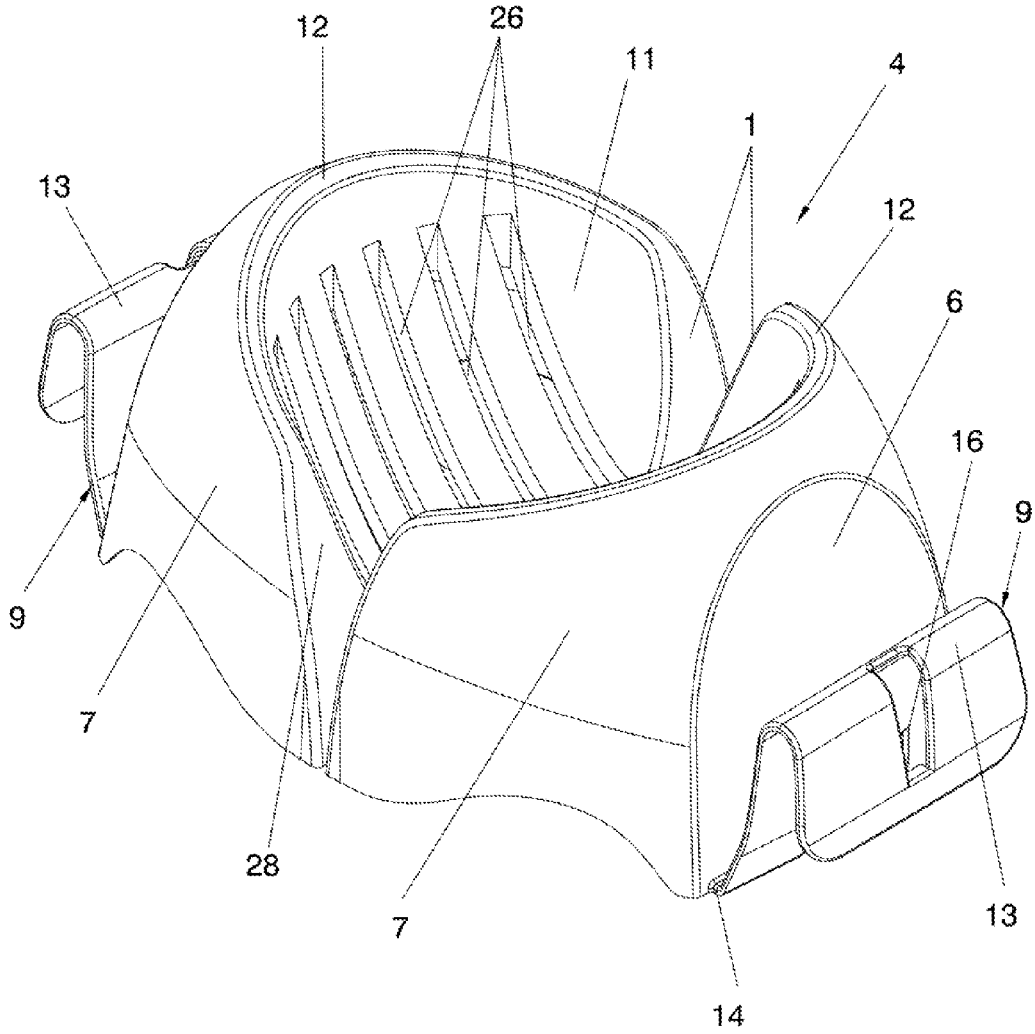
FIG. 1.—Shows a perspective view of a wringer for mops and the like, object of the invention FIG. 2.—Shows a sectional view of the wringer coupled at the mouth of the mop bucket.
Figure 2:
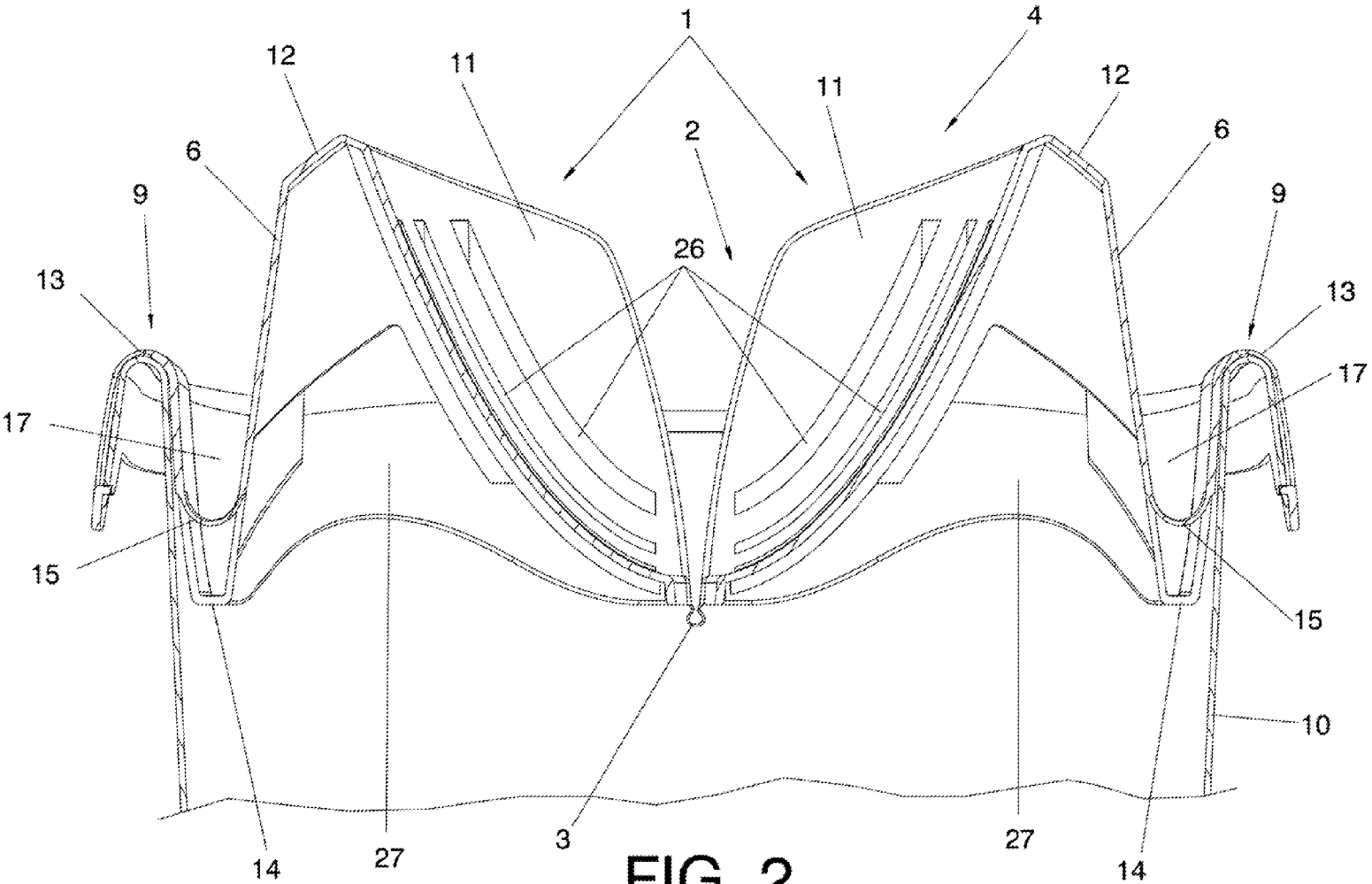
Figure 3:
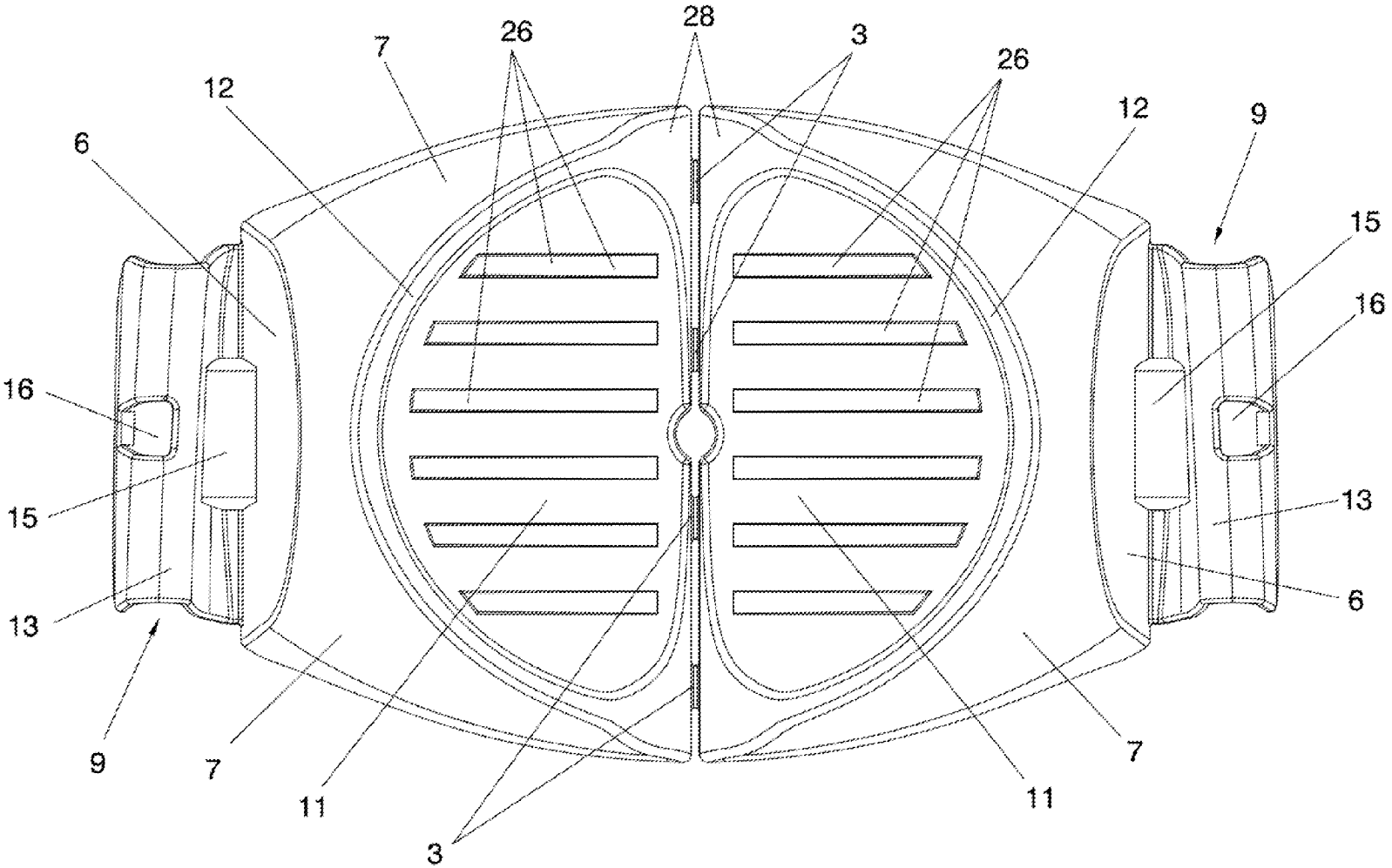
FIG. 3.—Shows a plan view of the wringer.
Figure 4:
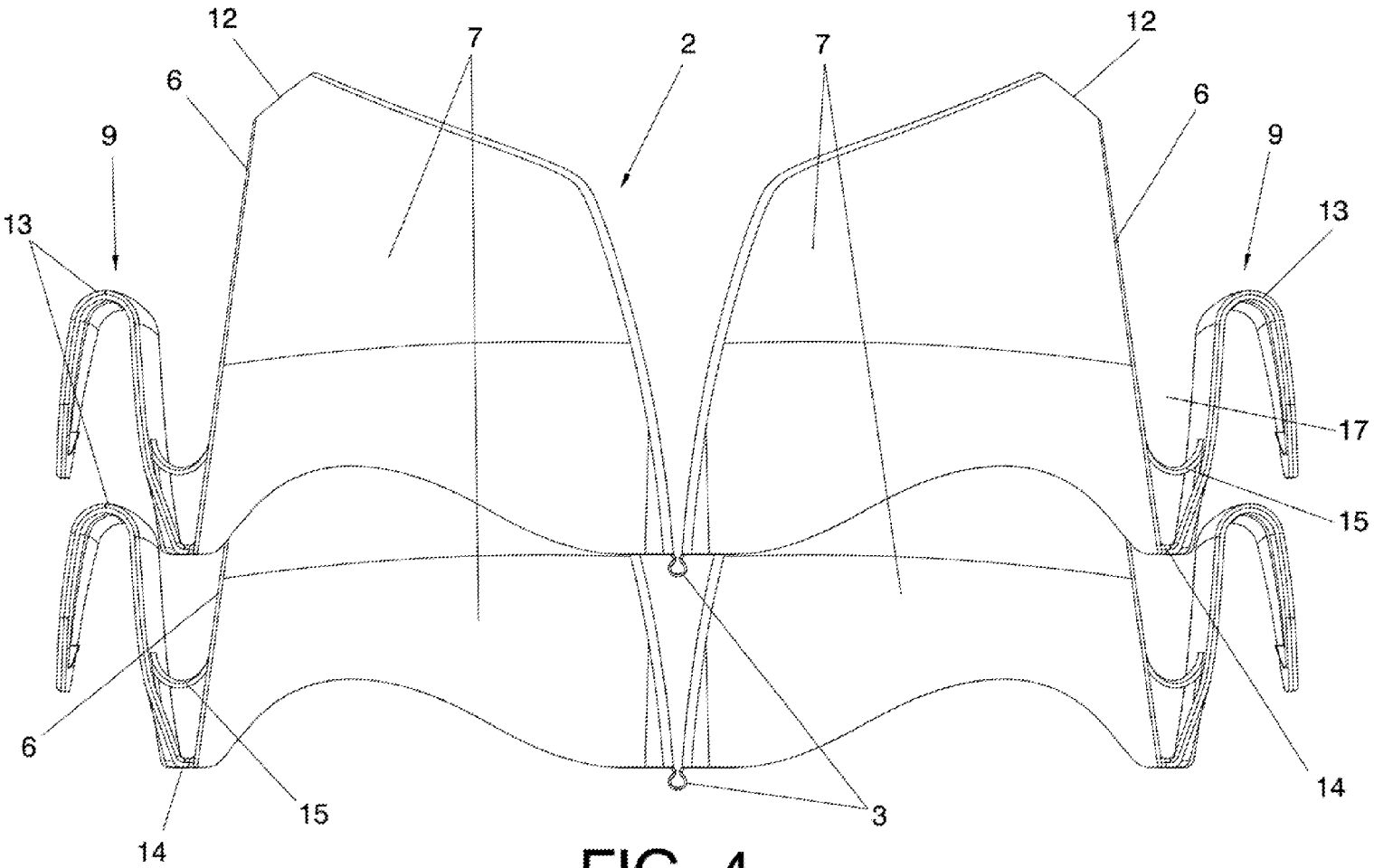
FIG. 4.—Shows a sectional view of two stacked wringers.
Figure 5:
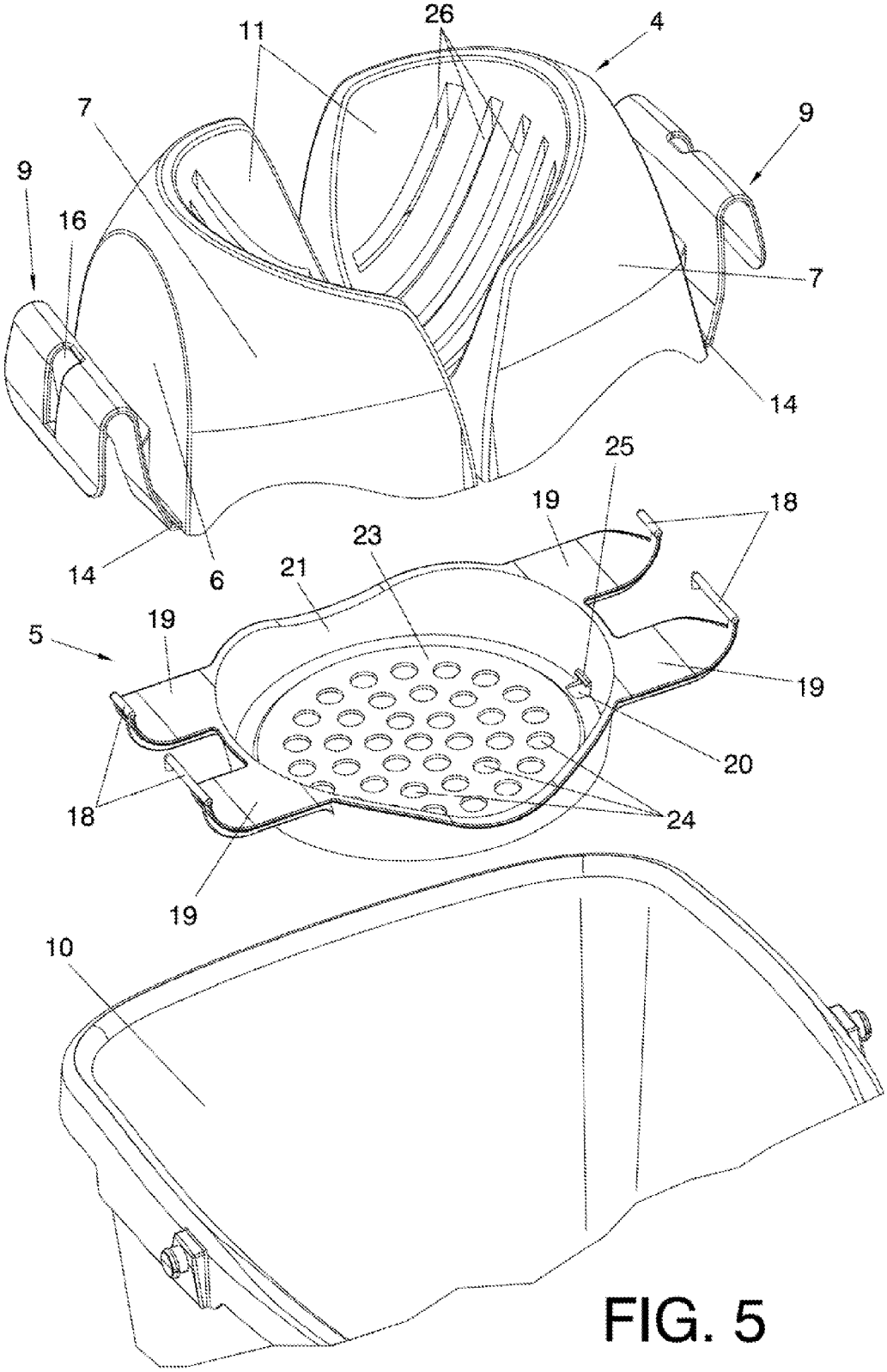
FIG. 5.—Shows an exploded view wherein a floor-scrubbing bucket including the wringer of the present invention and the device for filtering washing water is shown.
Figure 6:
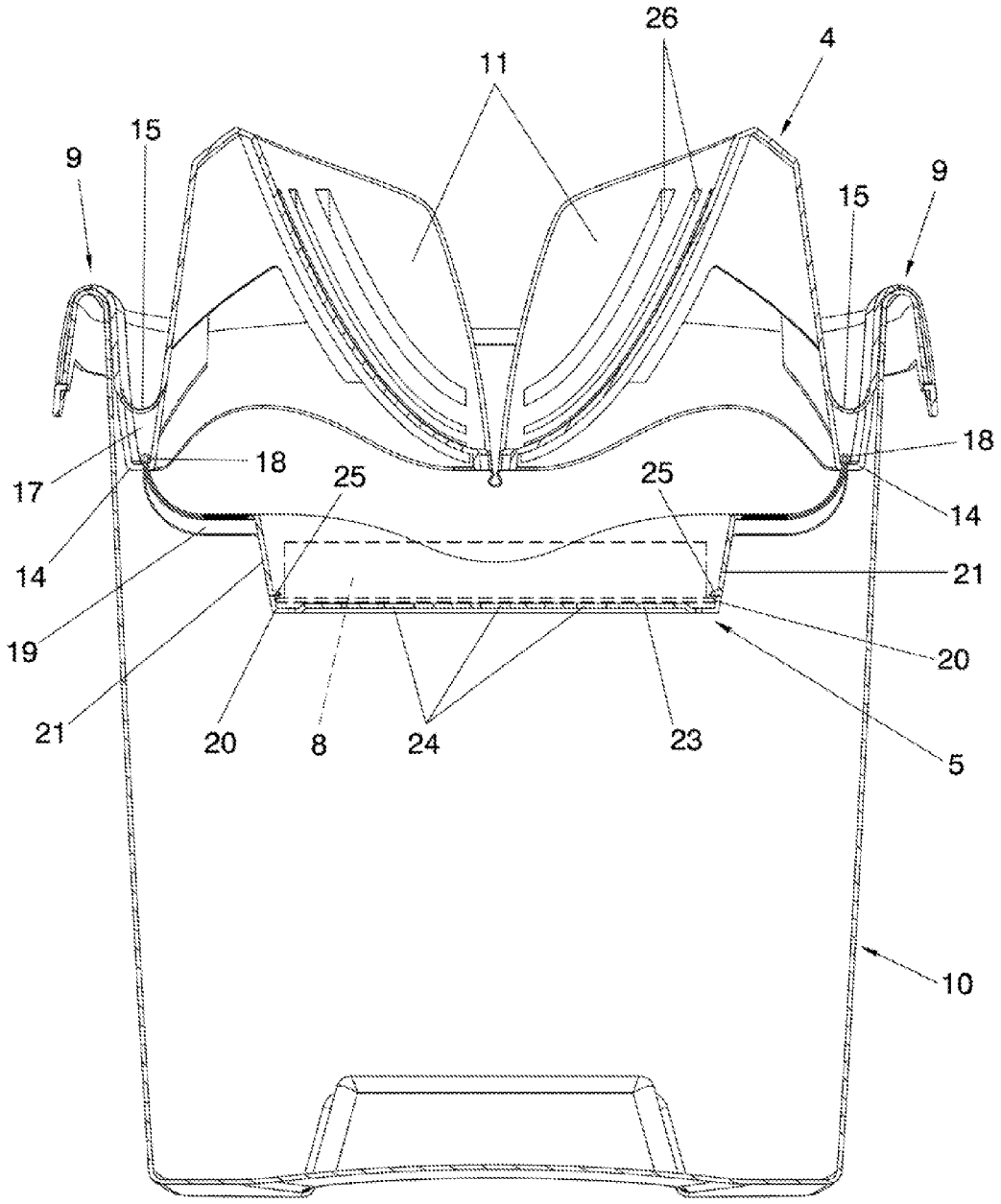
FIG. 6.—Shows a sectional view of that depicted in the previous figure.
Figure 7:
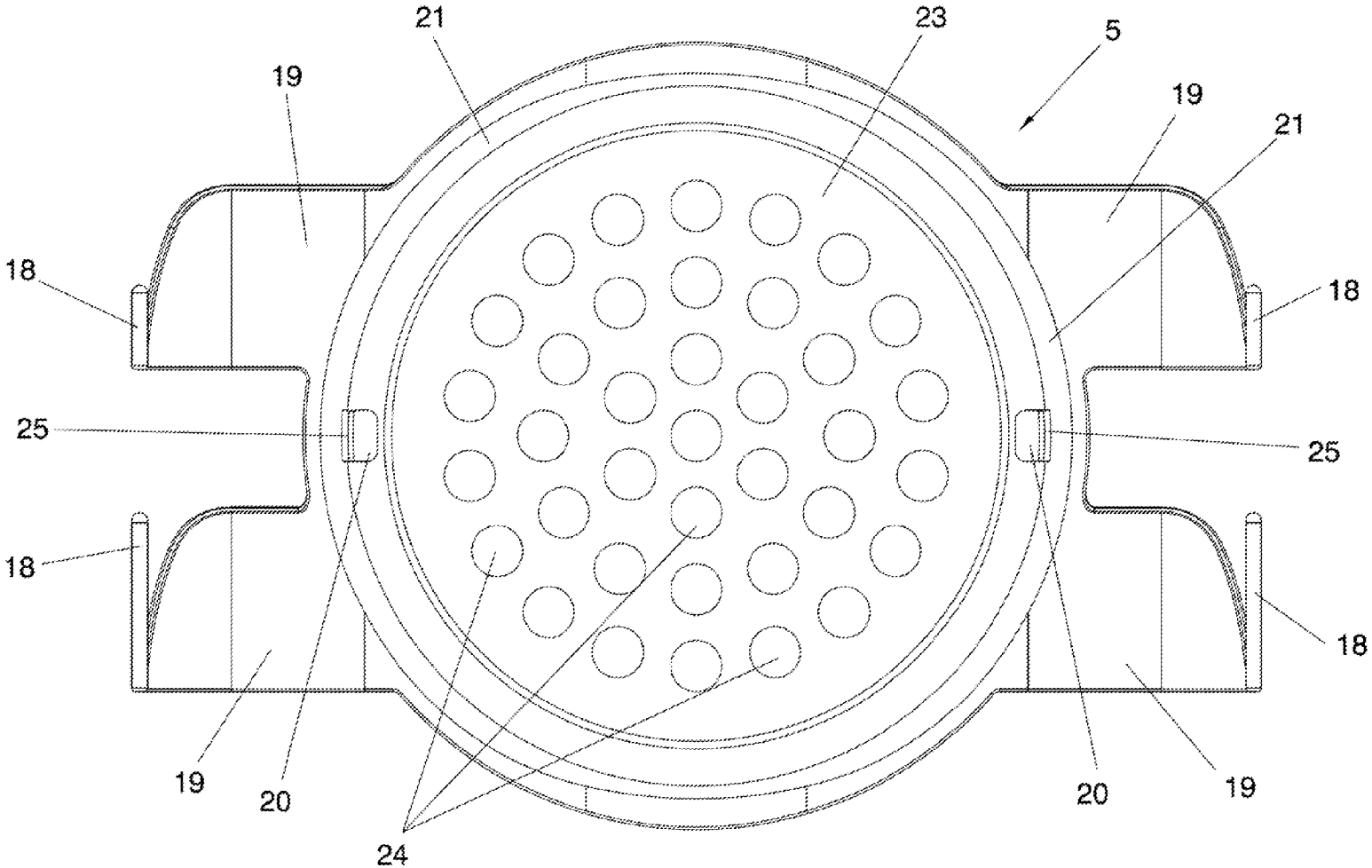
FIG. 7.—Shows a plan view of the filtering device.
Figure 8:
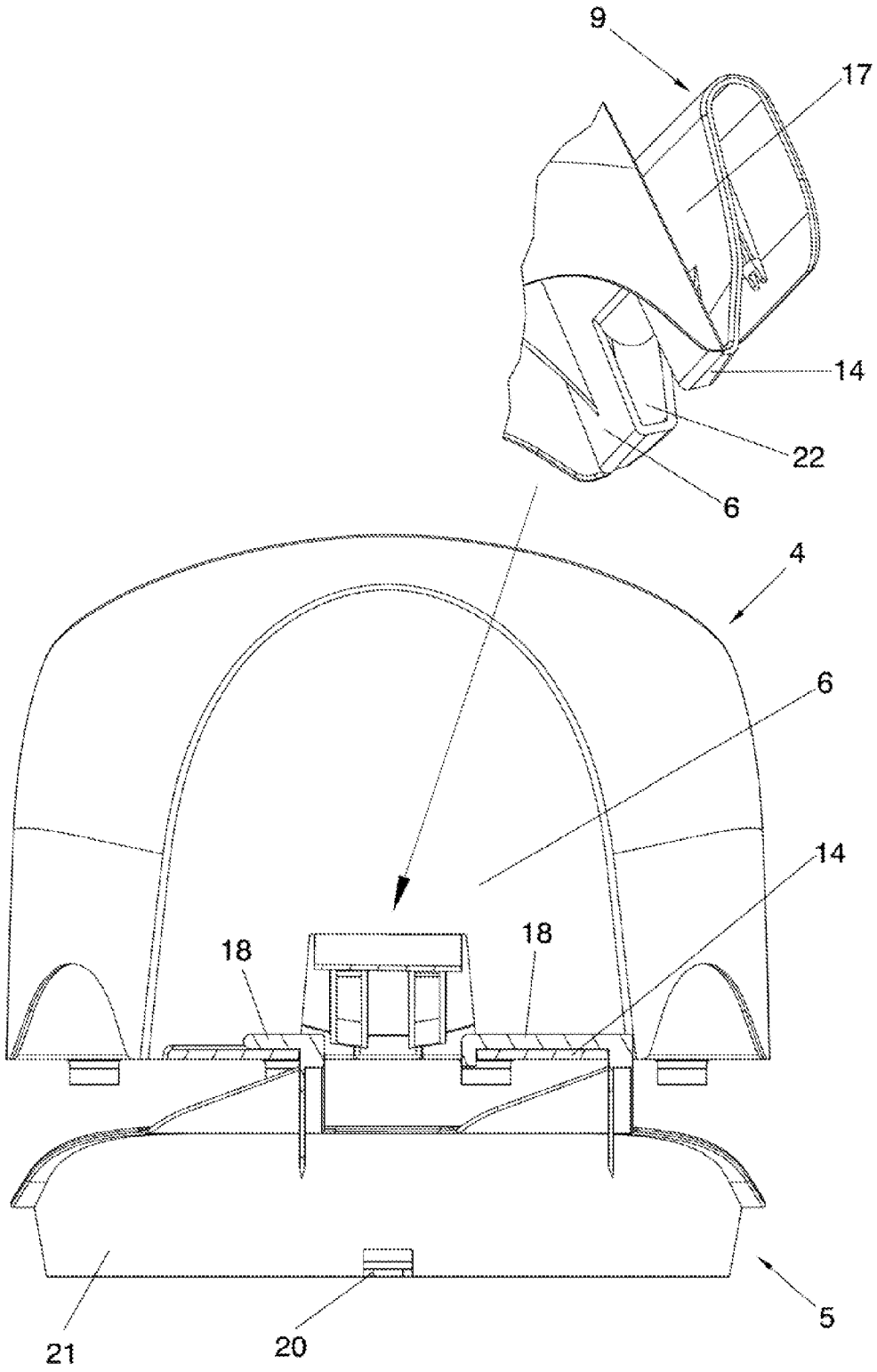
FIG. 8.—Shows a profile view wherein one can see how the filtering device is attached to the wringer.

1: rocking body
2: "V"-shaped channeling
3: middle fins
4: wringer
5: tray support
6: central flat portions
7: curve-convex outside walls
8: filter body
9: end portions
10: bucket
11: curve-concave inside walls
12: sloping wings
13: end parts
14: elastic hinge
15: spring elements
16: centered lower notch
17: middle groove
18: end shaft
19: wing
20: window
21: enveloping wall
22: middle notch
23: recessed cavity
24: through hole
25: flange
26: groove
27: lower gap

DESCRIPTION OF THE PREFERRED EMBODIMENT

Considering the numbering adopted in the figures, the wringer for mops and the like is defined by a one-piece structure made of plastic material comprising two rocking bodies 1 separated by "V"-shaped channeling 2 and which are joined at the bottom by means of middle fins 3, the rocking bodies 1 having some elastic hinge elements 14 and end portions 9 of elastic structure by which the wringer is anchored to the mouth of the mop bucket 10, the end portions 9 having some spring elements 15 for recovering the rocking bodies 1.

Rocking bodies 1 define lower gaps 27 limited by curve-concave inside walls 11 having grooves 26, and curve-convex exterior walls 7 having some central flat portions 6 from free edges of which end portions 9 with a elastic structure by which the wringer 4 is anchored to the mouth of the mop bucket 10 through two opposing areas of said mouth, are projected.

The inside walls 11 and outside walls 7 of the rocking bodies 1 are joined at the top by narrow sloping rocking wings 12, leading to some front widenings 28 of the inside walls 11.

The end portions 9 have an end portion shaped as an inverted "U" 13 that fits into the mouth of the mop bucket 10 so that the wringer 4 stably fits into said bucket 10.

The joining of the end portions 9 with the centered flat portions 6 of outside walls 7 constitutes some elastic hinge elements 14 of the two rocking bodies 1 along with the sloping rocking wings 12. These elastic hinges 14 act when the rocking bodies 1 are lowered by pressing the mop down for wringing on the curve-concave inside wall 11, as when that pressure ceases by moving the mop upward.

When the mop is moved upward, the two rocking bodies 1 recover their resting position thanks to the spring elements 15 joining the end portions 9 and the centered flat portions 6 of the curve-convex outside walls 7. These spring elements 15 are placed in a middle groove 17 and include an arched structure attached to the end part with a shape of an inverted "U" 13 and to the centered flat portions 6 of the curve-convex outside walls.

The end portions 9 of the side bodies 1 have some centered lower notches 16, which also exist in the centered flat portions 6.

Moreover the wringer 4 can have middle notches 22 that interrupt the bottom of the middle grooves 17 to allow placement of a tray support 5 under the wringer 4.

Said tray support 5 acts as a device for filtering the cleaning water so that when the mop head of the mop is wrung in the wringer 4, the water passes through said filtering device that is under the wringer 4 and reaches the bucket already filtered with fewer dirt particles.

The tray support 5 has pairs of wings 19 arched upward and provided with two separate end shafts 18 through which the tray support 5 is anchored to the wringer 4; said end shafts 18 being aligned in pairs.

The support tray has a recessed cavity 23 with a bottom perforated is by through holes 24. This recessed cavity 23 has an enveloping wall 21 having opposite flanges 25, and has the function of housing a filter body 8, the flanges 25 acting as a means for fastening the filter body. Said opposite flanges 25 are projected from the upper edge of some windows 20 also reaching the bottom of the mentioned recessed cavity 23.

In order to couple the tray support 5 in its position in relation to the wringer 4, the tray support 5 is placed under the wringer 4 by positioning two of the end shafts 18 of the tray support 5 in the middle notches 22 that interrupt the middle grooves 17 of the wringer 4, the other two pair of end shafts 18 being placed in correspondence with the areas adjacent to one of the ends of such middle grooves 17. At a later stage the tray support 5 is moved in a direction parallel to such middle grooves 17 until fitting the end shafts 18 into the elastic hinges 14 of the wringer 4.

In order to dismantle the tray support 5 one is to act in the same manner as described above but performing the motions in opposite directions as is done during mounting.

The invention claimed is:

1. A wringer for mops and the like, which is to be positioned and anchored at the mouth of a mop bucket at opposite areas of said mouth, said wringer comprising: two rocking bodies separated by a "V"-shaped channeling and joined at the bottom by middle fins, the rocking bodies having elastic hinge elements and end portions of elastic structure through which the wringer is anchored to the mouth of the mop bucket, the end portions having spring elements for recovering the rocking bodies.

2. The wringer of claim 1, wherein the end portions are projected from free edges of central flat portions that are part of curve-convex outside walls joined to curve-concave inside walls, such as between end portions and the central flat portions middle grooves bottom of which constitute the elastic hinge elements are defined, with middle grooves being interrupted by the spring elements defined by an arched structure joining a part of the end portions to the central flat portions of the curve-convex outside walls of the rocking bodies.

3. The wringer of claim 2, wherein the curve-concave inside walls and the curve-convex outside walls are joined at the top by narrow sloping rocking wings.

4. The wringer of claim 2, further comprising lower centered notches existing in the end portions and also the central flat portions of the curve-convex outside walls and the elastic hinge elements.

5. The wringer of claim 2, further comprising middle notches that interrupt the bottom of the middle grooves for allowing placement of a device for filtering cleaning water, which comprises a tray support and that is placed under the wringer.

6. The wringer of claim 5, wherein the tray support has means for supporting a filter body and means for anchoring the wringer.

7. The wringer of claim 6, wherein the means for anchoring the tray support to the wringer, comprise pairs of end shafts jointly connected to wings of the tray support, so that the end axes are coupled into fit holes of the wringer.

8. The wringer of claim 7, wherein the end shafts are placed in pairs of areas of the elastic hinges of the wringer, a first area corresponding to one of the end segments of each middle groove and a second area adjacent to the middle notches.

9. The wringer of claim 7, wherein the wings of the tray support have an arched structure from free ends of which the end shafts are projected aligned in pairs.

10. The wringer of claim 5, wherein the tray support includes a recessed cavity having through holes at the bottom, and wherein the filter body is adjusted.

11. The wringer of claim 10, wherein the recessed cavity of the tray support includes means for fastening the filter body, said means being for fastening opposite flanges projecting from an enveloping wall of the recessed cavity.

12. The wringer of claim 11, wherein the opposite flanges of the tray support are located in correspondence with the upper edges of windows existing both in the enveloping wall and the bottom of the recessed cavity of the tray support.

13. The wringer of claim 1, wherein the end portions include end parts each shaped as an inverted "U" comprising the means for anchoring the wringer on the edge or mouth of the mop bucket.

* * * * *